US005685934A

United States Patent [19]

Ikeda et al.

[11] Patent Number: 5,685,934

[45] Date of Patent: Nov. 11, 1997

[54] METHOD OF PRODUCING A REINFORCING FIBER SHEET

[75] Inventors: Tokuzou Ikeda; Akihiro Atsumi; Makoto Saito, all of Saitama-ken, Japan

[73] Assignee: Tonen Corporation, Tokyo, Japan

[21] Appl. No.: 505,984

[22] Filed: Jul. 24, 1995

[30] Foreign Application Priority Data

Jul. 29, 1994 [JP] Japan ..... 6-197722
Oct. 7, 1994 [JP] Japan ..... 6-268122

[51] Int. Cl.[6] ..... B05B 7/16; B05C 5/00

[52] U.S. Cl. ..... 156/178; 118/302; 118/315; 156/289; 156/324

[58] Field of Search ..... 156/324, 180, 156/181, 166, 289, 296, 178; 118/302, 315, 325

[56] References Cited

U.S. PATENT DOCUMENTS 4,873,937 10/1989 Bindes ..... 156/180
5,213,843 5/1993 Working ..... 156/180
5,264,036 11/1993 Haas ..... 118/415

*Primary Examiner*—Daniel Stemmer
*Attorney, Agent, or Firm*—Seidel, Gonda, Lavorgna & Monaco, PC

[57] ABSTRACT

A spray device is prepared has a plurarity of nozzles each of which has a capillary tube surrounded by a gas discharge pore at the end of the nozzle. A molten resin liquid is blown out to a reinforcing fiber from the capillary tube by heated air stream discharged through the gas discharge pore, so that a binder resin layer is formed on the reinforcing fiber. Following this, a resin-permeable supporting sheet and then a back-up sheet are applied to the binder resin layer side of the reinforcing fiber, and a releasing sheet is applied to the other side of the reinforcing fiber. The thus obtained superposed layers are pressed to adhere the reinforicing fiber, the supporting fiber and the back-up sheet to each other.

3 Claims, 10 Drawing Sheets

METHOD OF PRODUCING A REINFORCING FIBER SHEET

BACKGROUND OF THE INVENTION

1. FIELD OF THE INVENTION

This invention relates a method of producing a reinforcing fiber sheet which comprises reinforcing fibers formed on a supporting sheet through a binder resin layer.

2. PRIOR ART

Up to this time, a reinforcing fiber sheet has been used in a number of applications in the field of engineering works. In other industrial fields such as machinery and consumer electronics also, the reinforcing fiber sheet is increasingly being used with the aim of improving rigidity and strength.

This reinforcing fiber sheet, as shown in FIG. 14, comprises reinforcing fibers 104 unidirectionally arranged on a releasing paper 102 as a supporting body through a binder resin layer (adhesive layer) 103.

The unidirectional reinforcing fiber sheet 101 is, after impregnating the reinforcing fibers 104 with a matrix resin, wound around an overpass bridge column, and then the resin is hardened to render the reinforcing fiber sheet 101 into fiber-reinforced plastic, whereby the bridge column can be strengthened and damaged areas repaired.

Conventionaly, the unidirectional reinforcing fiber sheet mentioned above has been produced as shown in FIG. 15. Reinforcing fibers 104 in the form of fiber bundles are supplied to a pair of superposition rollers 132 and to this, releasing papers 102 and 135 are supplied from above and below, and then the reinforcing fibers 104 are sandwiched between releasing papers 102 and 135 by the superposition rollers 132. At this time, a binder resin layer 103 is formed on one releasing paper 102 by application roller 150. Next, the superposed layers are sent to a heating and pressurizing section 140, consisting of a pair of pressure rollers 138 and heaters 139 disposed before and after the rolleres; the superposed layers are then heated and pressed. As a result, the fiber bundles of reinforcing fiber 104 are slightly taken apart and the reinforcing fibers 104 are attached on the releasing paper 102 with the aid of binder resin layer 103. After that, the other releasing paper 135 is peeled off at the location of a pair of guide rollers 141, and a reinforcing fiber sheet 101 is obtained. The reinforcing fiber sheet 101 thus obtained is wound by a winding roller 146.

However, the coating of the binder resin layer 103 on the releasing paper 102 is carried out by adhering a resin made into a thin film 102 by the application roller 150 onto the releasing paper and for this reason, adjusting the thickness of the resin film is time consuming. Also, since the entire coating device increases in size, realistically, the coating device cannot be placed in the reinforcing fiber sheet production line and consequently, 2-stage production becomes necessary, wherein a binder resin layer is coated on the releasing paper outside the production line, this resin coated releasing paper is wound once, then placed back into the production line. For this reason, the coating of a binder resin layer 103 has heretofore been a very time-consuming procedure and the production efficiency of reinforcing fiber sheet has been low.

Thereupon, the present inventors carried out intensive research into a coating method in which a resin liquid is coated onto the reinforcing fiber so as to form the binder resin layer on the reinforcing fiber with less time and trouble by using a spray device. As a result, the present inventors found out that when a special spray device having a plurarity of nozzles tipped with capillary tubes positioned in gas discharge pores is used and a molten resin liquid is blown out onto the reinforcing fibers from the ends of the capillary tubes by heated streams of air blown out from the gas discharge pores, the molten resin liquid becomes droplets of an appropriate size to thereby adhere to the reinforcing fibers, so that a thin binder resin layer can be formed onto the reinforcing fibers and also the time and effort required for the coating is reduced.

SUMMARY OF THE INVENTION

Therefore, a purpose of this invention is to provide a method of efficiently producing a reinforcing fiber sheet by coating a binder resin layer on a reinforcing fiber with a spray device.

Another purpose of this invention is to provide a method of producing a reinforcing fiber sheet, in which fuzzing of the reinforcing fiber is prevented by coating a resin to the opposite side of the binder resin layer of the reinforcing fiber using a spray device.

The objectives mentioned above are achieved by the production method in accordance with the present invention. To summarize, the present invention is a method of producing a reinforcing fiber sheet comprising: preparing a spray device having a plurality of nozzles each of which has a capillary tube surrounded by a gas discharge pore at the end of said nozzle; blowing out a molten resin liquid from a lower end of said capillary tube by heated air stream discharged through the gas discharge pore to a reinforcig fiber and forming a binder resin layer on the reinforcing fiber; applying a resin-permeable supporting sheet and then a back-up sheet to the binder resin layer side of the reinforcing fiber, and applying a releasing sheet to the other side of the reinforcing fiber to form superposed layers; and pressing said superposed layers to adhere the reinforcing fiber, the supporting sheet and the back-up sheet to each other.

According to the present invention, instead of forming the binder resin layer onto the reinforcing fiber, the binder resin layer can be formed onto the resin-permeable supporting sheet. Following this, the reinforcing fiber and then the releasing sheet are applied to the binder resin layer side of the supporting sheet and the back-up sheet is applied to the other side of the supporting sheet, and the thus obtained superposed layers are pressed. Or, instead of forming the binder resin layer onto the reinforcing fiber, the binder resin layer can be formed onto the back-up sheet and following this, the resin-permeable supporting sheet and then the reinforcing fiber and lastly the releasing sheet are applied to the binder resin layer side of the back-up sheet, and the thus obtained superposed layers are subjected to the pressing. Whichever way, one can use a releasing sheet instead of the back-up sheet and after the aforementioned adhering of the reinforcing fiber, peel off the releasing sheet and apply the back-up sheet instead to affix.

Another enbodiment of the present invention is a method of producing a reinforcing fiber sheet comprising: preparing a spray device having a plurarity of nozzles each of which has a capillary tube surrounded by a gas discharge pore at the end of said nozzle; blowing out a molten resin liquid from a lower end of said capillary tube by heated air stream discharged through the gas discharge pore to a reinforcig fiber and forming a fuzz-preventing resin layer on thereinforcing fiber; applying a releasing sheet to the fuzz-preventing resin layer side of the reinforcing fiber, and applying a resin-permeable supporting sheet and then a resin-coated paper to the other side of the reinforcing fiber to form superposed layers, said resin-coated paper comprising a back-up sheet and a binder resin layer formed on the sheet; and pressing said superposed layers to adhere the reinforcing fiber with the fuzz-preventing resin layer, the supporting sheet and the back-up sheet to each other. In the same way, one can also use a relaseing sheet instead of the back-up sheet, and after the aforementioned adhreing of the reinforcing fiber, peel off the releasing sheet and apply the back-up sheet instead to affix.

It is desirable that said spray device has resin reservoirs each communicating with a resin entrance, air chambers each of which receives air from an air introduction passage and blows out the air to an air discharge pore, and nozzles, said each nozzle having a capillary tube which has an upper end opening being open to said resin reservoir and a lower end opening protruding to the position of said air discharge pore or further outward, said upper end opening of the capillary tube protruding upward from the lower surface of said resin reservoir.

DETAILED DESCRIPTION OF THE PREFERRED EMBODIMENTS

Figure 1:
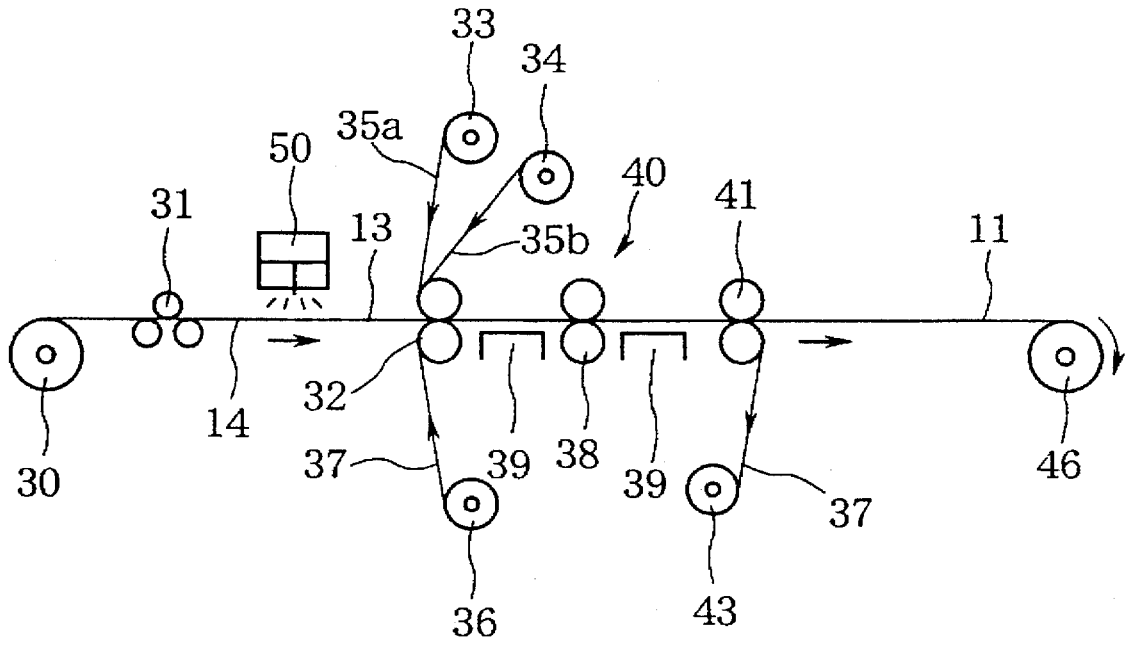
FIG. 1 is an explanatory view showing an embodiment of the method of producing a reinforcing fiber sheet of the invention.
Figure 2:
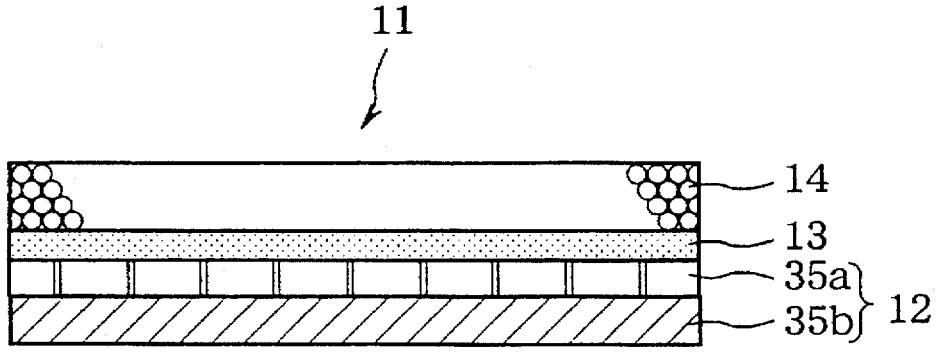
FIG. 2 is a cross-sectional view showing a unidirectional reinforcing fiber sheet produced by the method described in FIG. 1.

FIG. 1 is an explanatory view showing an embodiment of the method of producing a reinforcing fiber sheet according to the invention, and FIG. 2 is a cross-sectional view showing a unidirectional reinforcing fiber sheet produced using the method of FIG. 1.

As shown in FIG. 2, the unidirectional reinforcing fiber sheet 11 produced by the method of this embodiment comprises a reinforcing fiber 14 arranged in one direction on a sheet-shaped support 12 through a binder resin layer 13, and the support 12 is formed by superposing a glass mesh 35*a* as a supporting sheet and a releasing paper 35*b* as a back-up sheet.

As can be seen in FIG. 1, first of all, fiber bundles of the reinforcing fiber 14 are unrolled from a plurarity of supply rollers 30 and the reinforcing fiber 14 is supplied to a pair of superposing rollers 32 via break rollers 31 and en route, a molten resin liquid is coated onto the reinforcing fiber by a spray device 50, so that a binder resin layer 13 is formed on the reinforcing fiber.

This embodiment is characterized by the way in which the binder resin layer 13 is formed directly on the reinforcing fiber 14, which became possible through the use of the special spray device 50.

Up to now, nozzles with long, narrow slits have been well known, but when a spray device with this slit nozzles was used to coat a molten resin liquid, the molten resin liquid dripped down from the slits due to its low viscosity, and thus coating a uniform thin binder resin layer onto the reinforcing fiber 14 was difficult. On the other hand, when a spray device with normal nozzles was used and a resin liquid dissolved in a solvent was forced out by compressed air, the droplets of the resin blowing out were too fine and resembled spray, so that the binder resin layer could not be formed effectively on the reinforcing fiber 14. The damaging effect on the environment was also an issue of concern.

Figure 3:
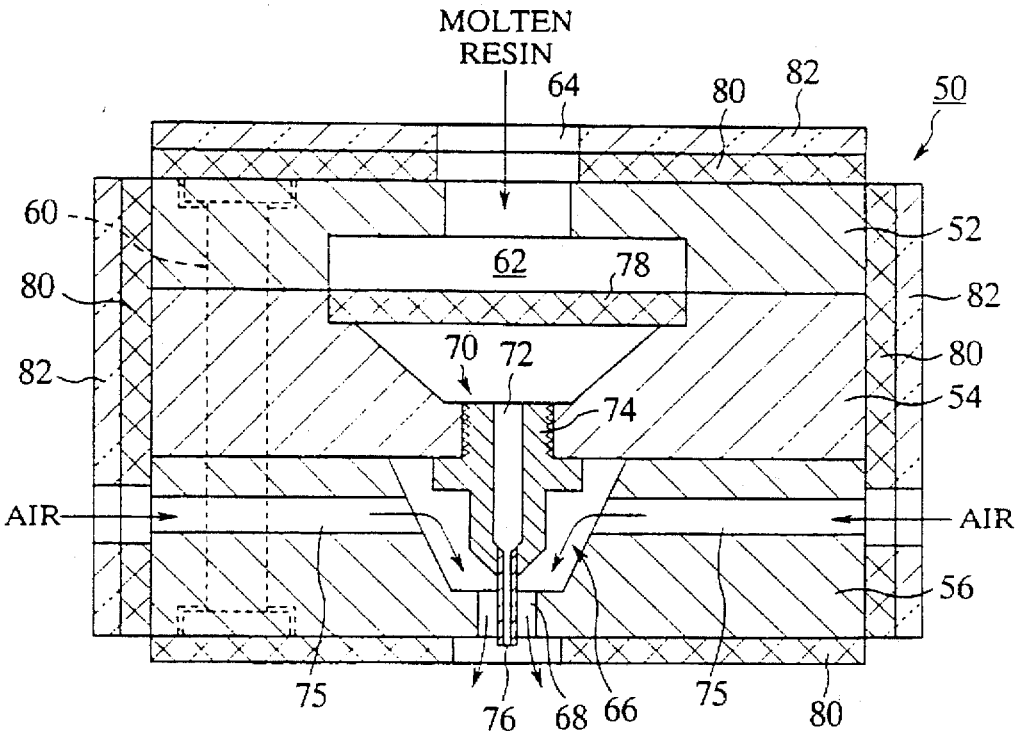
FIG. 3 ia a cross-sectional view showing an embodiment of the spray device used in the invention.
Figure 4:
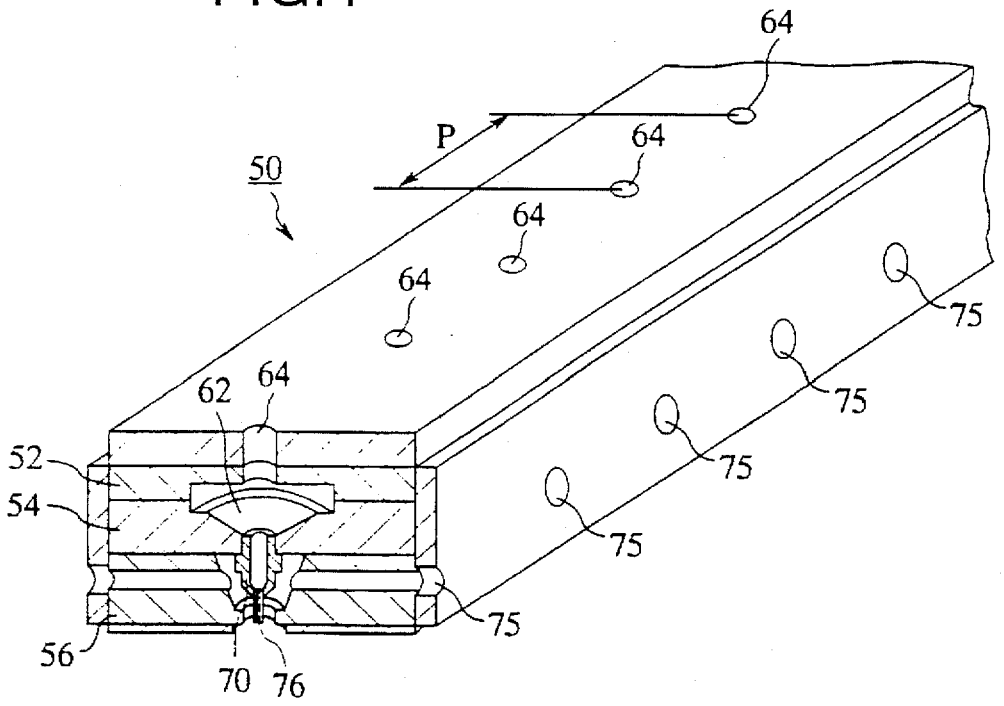
FIG. 4 is a perspective view of the spray device.

The structure of the resin spray device 50 used in the invention is shown in FIGS. 3 and 4. In this embodiment, the resin spray device 50 has a rectangular die lid 52, a nozzle plate 54 and an air plate 56, which are fixed by bolts 60 to each other. Resin reservoirs 62 are formed by the die lid 52 and nozzle plate 54. Resin entrances 64 communicating with the resin reservoirs 62 are formed in the die lid 52. Air chambers 66 are formed in the air plate 56 on the side of the nozzle plate 54. Air introduction passages 75 for introducing air to the air chambers 66 are formed in the air plate 56 such that the passages 75 communicate to the air chambers 66 and extend to the sides of the air plate 56. Air discharge pores 68 that blow out air from the air introduction passages 75 are formed in the nozzle plate 54 on the opposite side to the air plate 56.

In the nozzle plate 54, nozzles 70 are disposed on the lower part of the resin reservoirs 62. Each nozzle 70 comprises a base section 74 having a center pore 72 that communicates to the resin reservoir 62, and a capillary tube 76 which is fitted to the lower end portion of the base section 74 and communicates to the center pore 72. The base section 74 is positioned in the air chamber 66 formed in the air plate 56. The lower opening of the capillary tube 76 protrudes to the position of the air discharge pore 68 of the air plate 56, or further outward.

Plate heaters 80 are disposed on the outer surface of the spray divice 50. Heat-insulating materials 82 are fixed to the surfaces of the plate heaters 80 excluding the bottom plate heater.

The capillary tube 76 has an interior diameter of 0.1 to 1.0 mm, preferably 0.2 to 0.5 mm; a thickness of 0.2 to 0.5 mm; and a length of 10 to 50 mm, preferably 20 to 40 mm.

Also, according to this embodiment, the diameter of of the air discharge pore 68 formed in the air plate 56 is 0.7 to 5 mm, preferably 1.0 to 2 mm; its depth is 0.5 to 10 mm; and the difference between the outer diameter of the capillary tube 76 and the inner diameter of the air discharge pore 68 is 0.1 to 4 mm, preferably 0.2 to 1 mm. It is also desirable that the air entrance of the air discharge pore 68 is beveled to about three times the pore aperture. The length of the lower end of the capillary tube 76 that protrudes from the bottom surface of the air plate 56 is −2 to +5 mm, preferably 0 to +2 mm.

As shown in FIG. 3, this type of nozzle 70 is arranged at regular intervals by pitch P, along the length of the spray device 50, in a single row, or in multiple rows as required. The nozzle 70 arrangement pitch P is 18.0 mm, for example. The interval between nozzle rows is 15.6 mm, for example.

In the resin spray device 50 having above-mentioned structure, when a molten resin are introduced from the resin entrances 64 to the lower parts of the resin reservoirs 62 through filters 78 located in the resin reservoirs 62, the molten resin passes through to the center pores 72 of the nozzles 70 and following this, are guided to the capillary tubes 76. At the same time, air is passed from around the nozzles to the discharge pores 68 through the air introduction passagess 75, thereby the molten resin is carried on the flowing heated air streams and blows out from the ends of the capillary tubes 76 to form droplets measuring 5 to 1000 μm, preferably 50 to 100 μm.

At this time, the temperature of the molten resin introduced to the resin reservoir 62 is maintained within a prescribed temperature range of 120° to 150° C., preferably 130° to 140° C.; also, the heated air stream that passes through the air introduction passage 75 and is blown out from the discharge pore 68, is discharged from the end of the capillary tube 76 with a discharge pressure (gauge pressure), of 0.2 to 10.0 kg/cm$^2$, preferably 2.0 to 3.0 kg/cm$^2$.

Owing to this size of droplet, the resin liquid does not form a spray or drip down, so that the resin can be thinly adhered to the reinforcing fiber 14 positioned on the upper side of a fiber bundle. Thus, a binder resin layer 13 can be thinly and uniformly formed on the reinforcing fiber 14.

Figure 5:
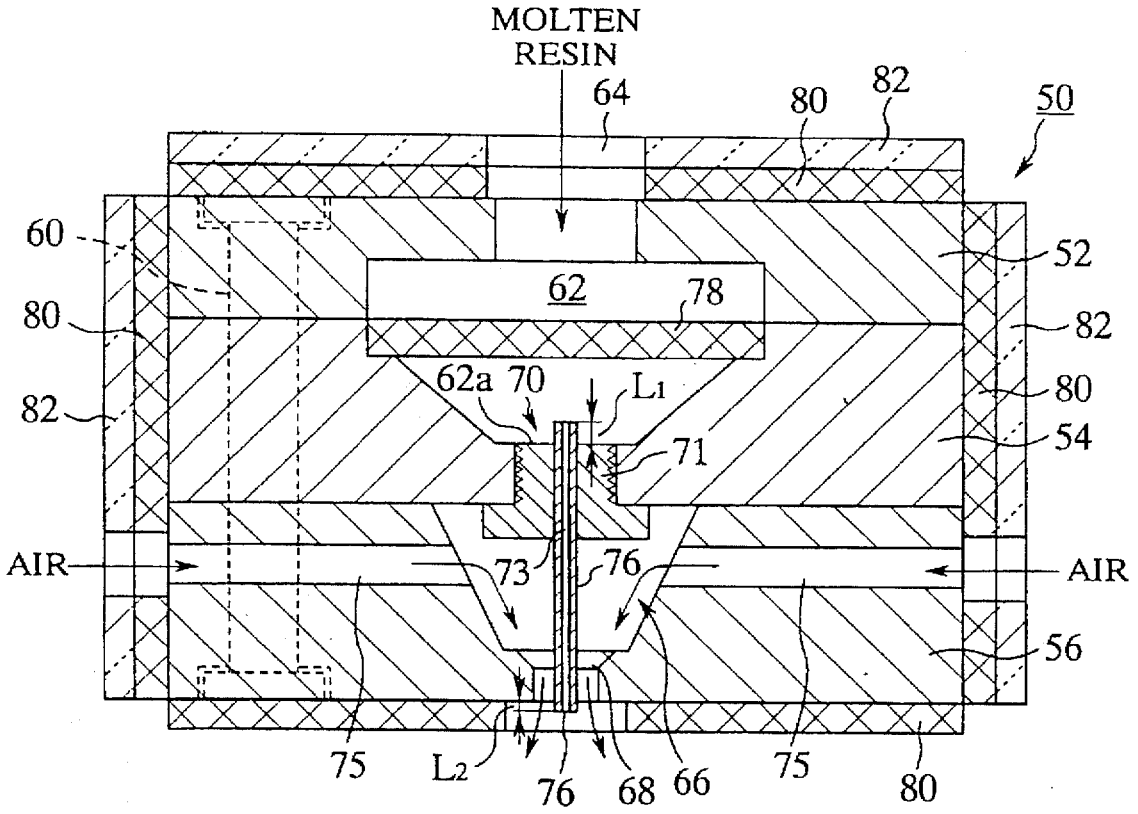
FIG. 5 is a cross-sectional view showing yet another embodiment of the spray device used in the invention.

Another embodiment of the resin spray device 50 used in this invention is shown in FIG. 5. This spray device 50 differs from the spray device shown in FIGS. 3 and 4 in the nozzle only, and all other structures are the same.

According to this embodiment, the nozzle 70 is fixed to the lower wall section that forms the lower side 62*a* of the resin reservoir 62 of the nozzle plate 54. The nozzle 70 is formed by attaching a capillary tube 76 to this lower wall section en bloc, by a mounting 71. For the mounting 71 may be used a bolt in the center of which a center pore 73 for installation of the capillary tube is formed and which is screwed into the nozzle plate wall. The capillary tube 76 is fixed in the center pore 73 of the mounting 71 by press-fitting in or welding.

The upper end of the capillary tube 76 is important to be mounted to protrude by a length (L1) of 0.5 to 5 mm, preferably 2 to 3 mm, upwards from the wall portion of the nozzle plate 54, in other words, upwards from the lower surface 62*a* of the resin reservoir 62. The length (L2) of the lower end of the capillary tube 76 that protrudes from the lower face of the air plate 56 is −2 to +5 mm, preferably 0 to +2 mm.

In the spray device shown in FIG. 2, there are occasions when a small amount of molten resin will harden in the resin reservoir 62 and sometimes this hardened resin sinks down to the lower part of the resin reservoir 62, enters the capillary tube 76 and reduces the amount of liquid resin that blows out from the capillary tube 76. Therefore, there is a fear that when spraying is carried out for long periods, the amount of liquid resin discharged from the capillary tube 76 will decrease and a uniform application of liquid resin to the reinforcing fiber will not be obtained.

According to the spray device 50 of the this embodiment, since the capillary tube 76 protrudes upwards from the entrance of the nozzle 70, the entry of hardened resin and other foreign bodies into the capillary tube 76 can be prevented for a long period of time, and thus the ability to apply a uniform coat of liquid resin is extremely improved.

Figure 6:
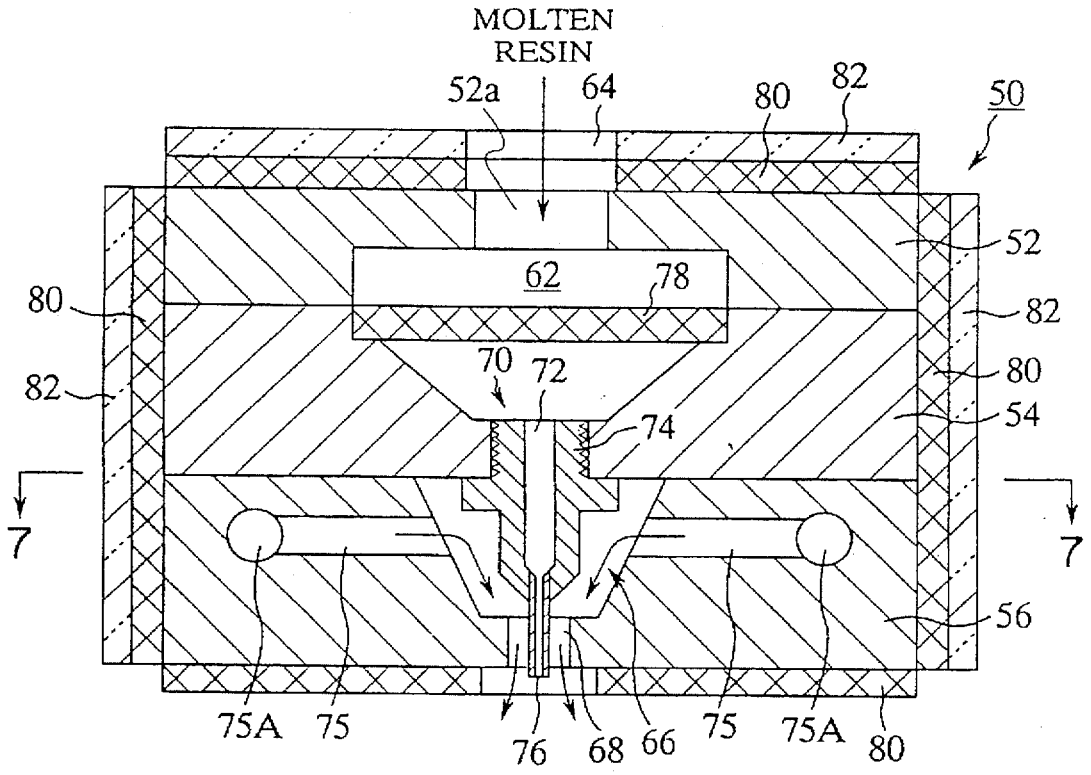
FIG. 6 is a cross-sectional view showing yet another embodiment of the spray device used in the invention.
Figure 7:
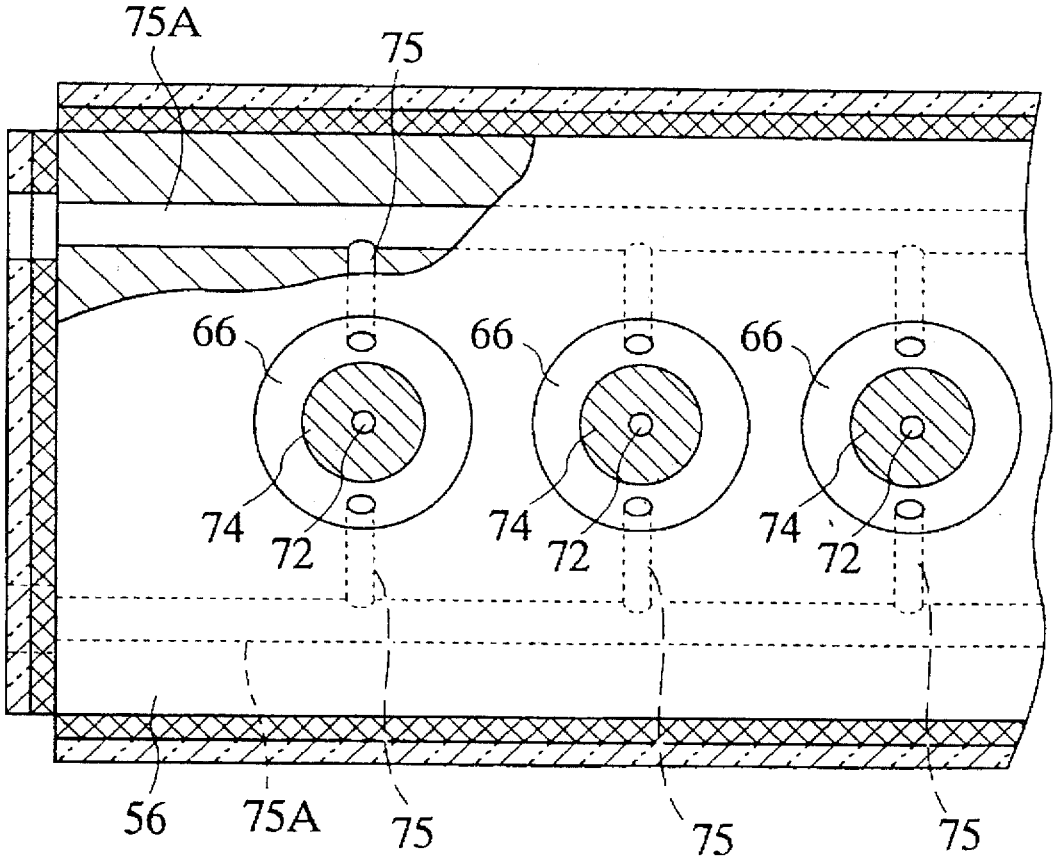
FIG. 7 is a cross-sectional view taken along line 7—7 of FIG. 6.

FIG. 6 is a coss-sectional view showing another embodiment of the resin spray device 50 used in the present invention, and FIG. 7 is a coss-sectional view taken along line 7—7 of FIG. 6. This spray device 50 has the same construction as that of the spray device shown in FIGS. 3 and 4, except that the device 50 has two main passages 75A for air introduction. The main air introduction passages 75A are formed along the length of the air plate 56, each said main passage 75A communicating with the air introduction passages 75. One of the main air introduction passages 75A may be used a spare passage, so that usually, both outer ends of said spare main passage 75A may be closed.

In the spray device 50, air is introduced through an inlet of the other main passage 75A into the passages 75, and is passed from around the nozzles 70 to the discharge pores 68.

Figure 8:
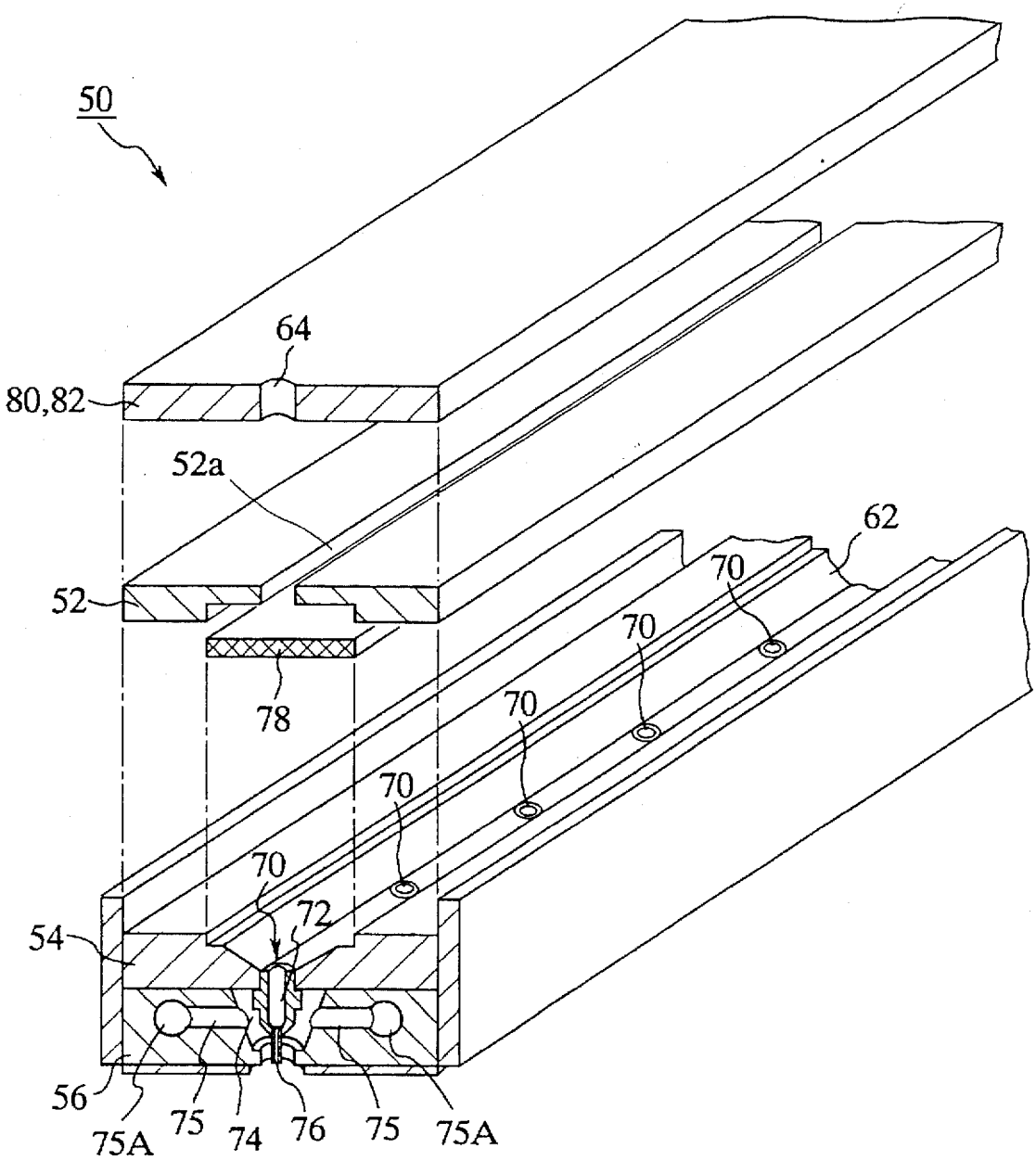
FIG. 8 is a perspective view showing yet another embodiment of the spray device used in the invention.

Further, in the resin spray device 50 of this embodient, as shown FIG. 8, the nozzle plate 54 has a resin resrvoir 62 in the form of a groove. The upper ends of the nozzles 70 open to the resin resrvoir groove 62. One resin entrance 64 is drilled in the plate heater 80 and heat-insulating material 82. The die lid 52 has a slit 52*a* along the length thereof. The filter 78 which is located in the resin resrvoir groove 62, has a rectangular form extending along the length of the resin resrvoir groove 62.

In this embodiment, when a molten resin is introduced from the resin entrance 64 to the lower part of the resin resrvoir groove 62, through the filter 78 disposed in the resin resrvoir groove 62, the molten resin is fed to the nozzles 70.

As a resin for the bider resin layer 13, epoxy resin, unsaturated polyester resin, vinyl ester resin, etc., may be used. The binder resin layer 13 suitably has a resin amount of 1 to 50 g/m$^2$, more preferably 2 to 15 g/m$^2$. Also, as the reinforcing fiber 14, pitch-type carbon fiber, glass fiber, steel fiber, polyester fiber, polyethlylene fiber, etc., may be used.

For the reinforcing fiber 14 coated with the binder resin layer 13 as described above, a glass mesh 35*a* as a supporting sheet and a releasing paper 35*b* as a back-up sheet, are unrolled from supply rollers 33 and 34 and supplied from above, as shown in FIG. 1, and a releasing paper 37 as a releasing sheet is unrolled from a supply roller 36 and supplied from below. And using the pair of superposition rollers 32, the reinforcing fiber 14 is sandwiched between the releasing paper 35*b* having the glass mesh 35*a* interior side, and the releasing paper 37, with its binder resin layer 13 facing the side of the glass mesh 35*a*.

As the back-up sheet, in addition to the releasing paper, polyethylene film such as LDPE film or HDPE film, or polypropylene film such as CPP film or OPP film, and furthermore, PET (polyester) film or nylon film can be used. As the supporting body sheet, a cloth such as a glass fiber cloth, glass fiber mesh, aramid fiber cloth, carbon fiber cloth, glass fiber paper (unwoven cloth), aramid fiber unwoven cloth, thin paper, or carbon fiber unwoven cloth (paper) and furthermore, punching film may be used.

Next, these superposed layers are sent to the heating and pressurization part 40, consisting of a pair of pressure rollers 38, preceded and followed by a heater 39, where they are heated and pressurized. As a result, the fiber bundles of the reinforcing fiber 14 are slightly taken apart and that fiber 14 is attached onto the glass mesh 35*a* and releasing paper 35*b* with the aid of the binder resin layer 13.

The releasing paper 37 is taken up and peeled by take-up roller 43 from the location of guide rollers 41, and thus the reinforcing fiber sheet 11 is obtained. The reinforcing fiber sheet 11 obtained is wound by a take-up roller 46.

Figure 9:
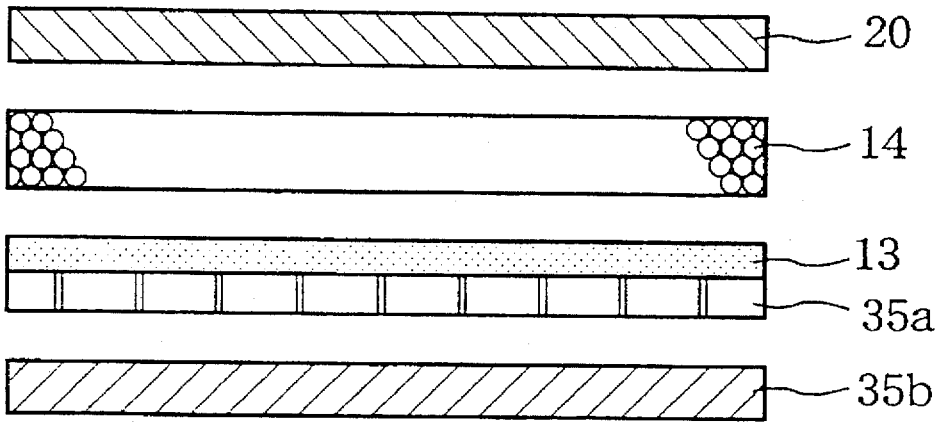
FIG. 9 is a cross-sectional view showing the laminated structure of a unidirectional reinforcing fiber sheet in avariation of the method of the invention.

In the above explanation, the binder resin layer 13 was formed on the reinforcing fiber 14, but as shown in FIG. 9, it can be formed on the glass mesh 35*a* instead of the reinforcing fiber 14. In this case, the reinforcing fiber 14, then the releasing sheet 20, are supplied to the glass mesh 35*a* on the side of the binder resin layer 13, and the releasing paper 35*b* as a back-up sheet is supplied to the glass mesh 35*a* on the opposite side to the binder resin layer 13. And the reinforcing fiber 14 is sandwiched and pressure-adhered. By pressure-adhesion, the binder resin layer 13 adheres the glass mesh 35*a* to the reinforcing fiber 14, and the binder resin from the binder resin layer 13 then permeates the glass mesh 35*a* and adheres the glass mesh 35*a* to the releasing paper 35*b*, and thus the reinforcing fiber sheet 11 is obtained. After the pressure-adhesion, the releasing sheet 20 is peeled.

Figure 10:
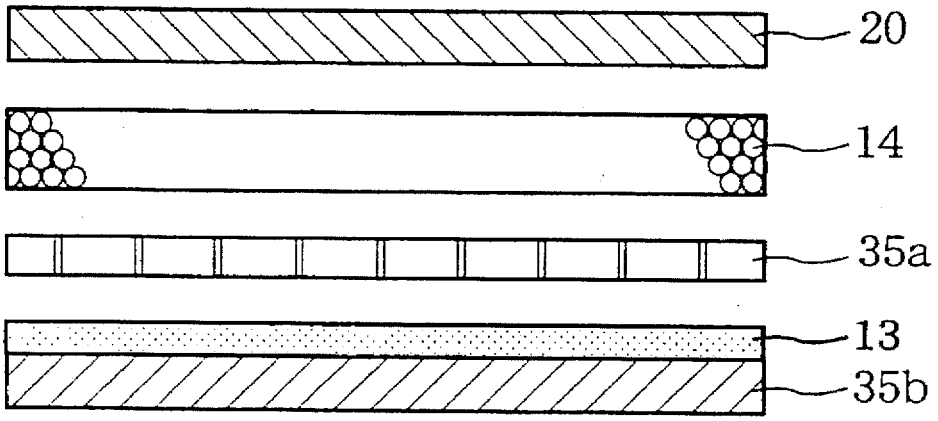
FIG. 10 is a cross-sectional view showing the laminated structure of a unidirectional reinforcing fiber sheet in another variation of the method of the invention.

Alternatively, as shown in FIG. 10, the binder resin layer 13 is formed on the releasing paper 35*b* as a back-up sheet, and the glass mesh 35*a*, the reinforcing fiber 14 and the releasing sheet 20 are applied to the binder resin layer 13 side of the releasing paper 35*b*. And the reinforcing fiber 14 is sandwiched between the releasing paper 35*b* and the releasing sheet 20 and is pressure-adhered. By the pressure-adhesion, the binder resin layer 13 adheres the releasing paper 35*b* to the glass mesh 35*a* and the binder resin from the binder resin layer 13 permeates the glass mesh 35*a* to adhere the glass mesh 35*a* to the reinforcing fiber 14. Thus, a reinforcing fiber sheet similar to the reinforcing fiber sheet 11 is obtained. After the pressure-adhesion, the releasing sheet 20 is peeled.

In the explanation above, the supporting body 12 is formed by superposing the glass mesh 35*a* as a supporting sheet and the releasing paper 35*b* as a back-up sheet, but a releasing paper etc. by itself may be used as a supporting body.

Figure 11:
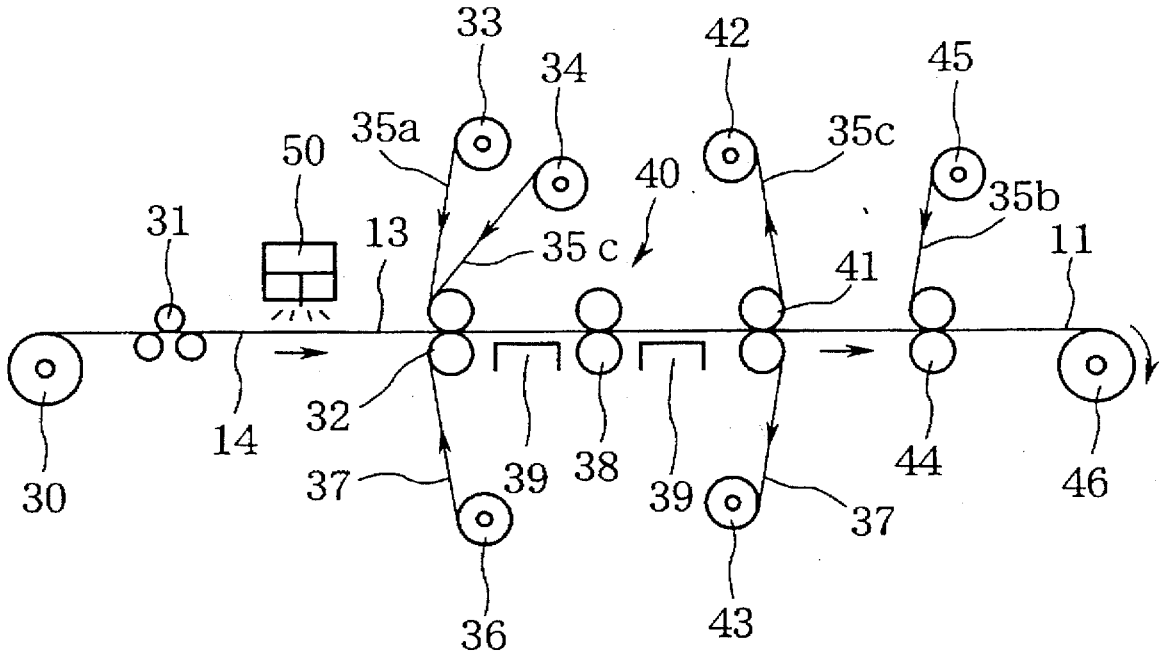
FIG. 11 is an explanatory view showing yet another variation in the method of the invention.

FIG. 11 is an explanatory view showing another embodiment of the method of producing a reinforcing fiber sheet according to the present invention. In this embodiment, instead of using the releasing sheet 35*b* as a backing sheet from the beginning as in the first embodiment of FIG. 1, first of all, a releasing paper 35*c* is used as a releasing sheet, as shown in FIG. 11. This is supplied from the supply roller 34 to the reinforcing fiber 14 having the binder resin layer 13 formed thereon and in the same way, the reinforcing fiber 14 is sandwiched between the releasing sheet 35*c* having a glass mesh 35*a* inner side, and the releasing paper 37, with the binder resin layer 13 facing the glass mesh 35*a* side. It is then sent to the heating and pressurizing part 40, where it is heated and pressurized; the fiber bundles of the reinforcing fiber 14 are slightly taken apart and the fiber 14 is pressure-adhered to the glass mesh 35*a* and the releasing sheet 35*c* by means of the binder resin layer 13.

Following this, after the releasing sheet 35*c* and the releasing paper 37 are taken up and peeled by take-up rollers 42 and 43 from the location of the guide rollers 41, a releasing paper 35*b* as a back-up sheet is supplied from a supply roller 45 and this is disposed on the glass mesh 35*a* by the guide rollers 44, and thus the releasing paper 35*b* is affixed instead of the releasing paper 35*c*. As a result, in the same way as the first embodiment, the reinforcing fiber sheet 11 shown in FIG. 1 is obtained. The reinforcing fiber sheet 11 thus obtained is wound by the take-up roller 46.

As described above, in this embodiment, a technique such that a releasing sheet 35*c* is used initially and following pressure-adhesion of reinforcing fiber 14, the releasing sheet 35*c* is replaced with releasing paper 35*b*, is applied to the method of the first embodiment, but one can also do the same with the methods shown in FIGS. 9 and 10.

Figure 12:
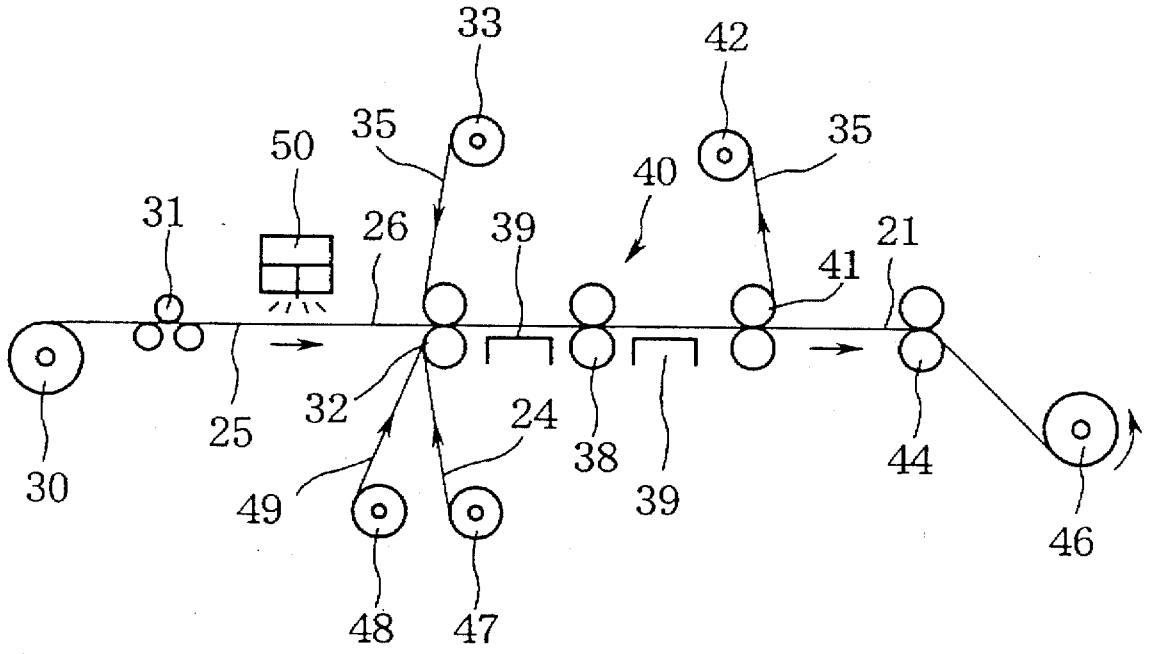
FIG. 12 is an explanatory view showing yet another variation in the method of the invention.
Figure 13:
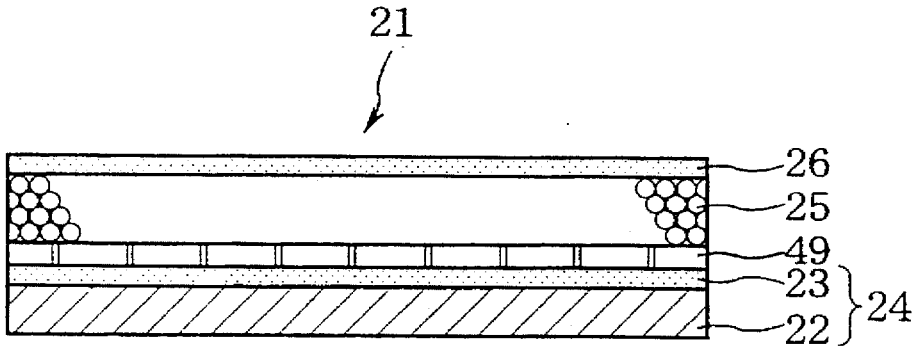
FIG. 13 is a cross-sectional view showing a unidirectional reinforcing fiber sheet produced by the method described in FIG. 9.
Figure 14:
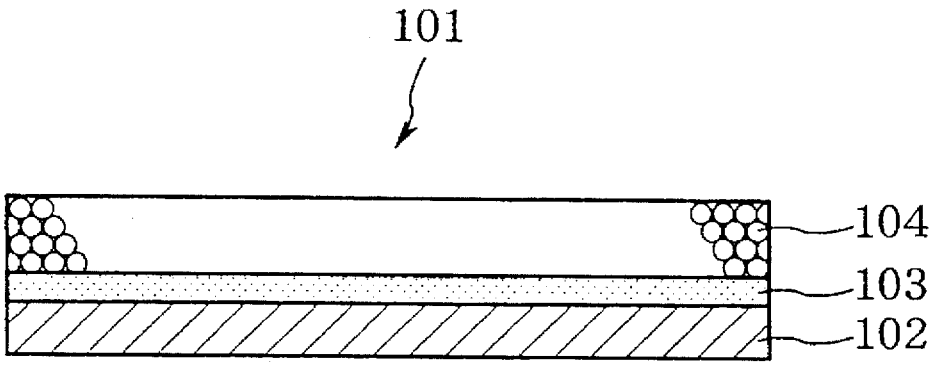
FIG.14 PRIOR ART
FIG. 14 is a cross-sectional view showing a conventional unidirectional reinforcing sheet.
Figure 15:
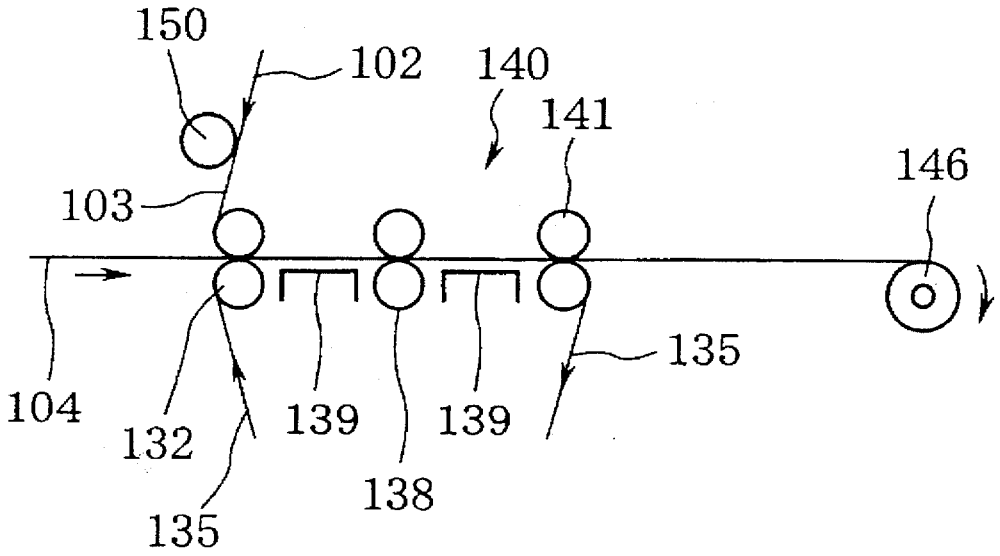
FIG.15 PRIOR ART
FIG. 15 is an explanatory view showing a conventional method of producing a unidirectional reinforcing fiber sheet.

FIG. 12 is an explanatory view showing another embodiment of the method of producing a reinforcing sheet according to the present invention. This embodiment, as shown in FIG. 13, relates to a method of producing a unidirectional reinforcing fiber sheet 21, designed to prevent the fuzzing of a reinforcing fiber 25. A fuzz-preventing resin layer 26 for the fiber 25 is formed using the spray device 50, that is fitted with special nozzles, as described above. The reinforcing fiber sheet 21 is formed by arranging the reinforcing fiber 25 in one direction on a releasing paper 22 through a binder resin layer 23 and also applying the fuzz-preventing resin layer 26 on the reinforcing fiber 25.

As shown in FIG. 12, the reinforcing fiber 25 in the form of fiber bundles is rolled out from a plurarity of supply rollers 30 and after the reinforcing fiber 25 has passed through brake rollers 31, it is supplied to a pair of superposition rollers 32 and en route, using the spray device 50 shown in FIGS. 3 or 5, the fuzz-preventing resin layer 26 is coated on the reinforcing fiber 25.

A molten resin liquid is introduced into the resin reservoirs of the spray device 50 and guided to the capillaries 76 and while the temperature of the molten resin liquid is maintained within a prescribed temperature range of 20° to 100° C., preferably 55° to 65° C., by the plate heaters 80, the molten resin liquid is carried on the heated air streams that pass through the air introduction passages 75 and are discharged from air discharge pores 75. The molten resin liquid is discharged from the ends of the capillary tubes 56 at a discharge pressure (gauge pressure) of 0.1 to 5.0 kg/cm$^2$, preferably 0.7 to 1.2 kg/cm$^2$, as droplets measuring 1 to 200 μm, preferably 25 to 75 μm.

As a result, the molten resin liquid does not form a spray or drip down and it lightly adheres to the reinforcing fiber 25 on the upper side of the fiber bundles, so that the fuzz-preventing or fluffy-preventing layer 26 is thinly and uniformly formed on the reinforcing fiber 25. Also, a portion of the resin liquid droplets penetrates inside the fiber bundles, so when the reinforcing fiber sheet 21 is used, the reinforcing fibers 25 is converged to prevent fuzzing.

As a resin that forms the fuzz-preventing layer 26, epoxy resin, unsaturated polyester resin and vinyl ester resin, etc. may be used. The fuzz-preventing resin layer 26 suitably has a resin amount of 1 to 30 g/m$^2$, more preferably 3 to 15 g/m$^2$.

As can be seen in FIG. 12, a releasing paper 35 as a releasing sheet is unwound from the supply roller 33 and supplied from above to the reinforcing fiber 25 having the fuzz-preventing resin layer 26, and a resin-coated paper 24, unwound from a supply roller 47, and a glass mesh 49 as a supporting sheet unwound from a supply roller 48, are supplied from below. This resin-coated paper 24, as shown in FIG. 13, is composed of a releasing paper 22 over which a binder resin layer 23 has been coated beforehand. The reinforcing fiber 25 is sandwiched between the releasing paper 35 and the glass mesh 49 by the pair of superposition rollers 32, with the fuzz-preventing layer 26 facing the releasing paper 35.

Next, these superposed layers are sent to the heating and pressurizing part 40 and are heated and pressurized by the before and after heaters 39 and the pressure roller 38. As a result, the fiber bundles of the reinforcing fiber 25 are slightly taken apart and the reinforcing fiber 25 is pressure-adhered to the releasing paper 22 of the resin-coated paper 24 through the glass mesh 49 and the binder resin layer 23.

After that, when the releasing paper 35 is taken up and peeled by the take-up roller 42 from the location of the guide rollers 41, the unidirectional reinforcing fiber sheet 21 shown in FIG. 13 is obtained, with the reinforcing fiber 25 designed to prevent fluffying, and this reinforcing sheet 21 is wound by the take-up roller 46.

This reinforcing fiber sheet 21 is designed to prevent fuzzing of the reinforcing fiber 25 by the resin layer 26, so it is very convenient for handling.

In the above embodiment, the resin-coated paper 24 comprising a releasing paper 22 as a back-up sheet and the binder resin layer 23 fomred on the releasing paper is used, and the supporting body is composed of the glass mesh 49 and the releasing paper 22 adhered to each other by the binder layer 23. However, a releasing paper etc. independently can be used as the supporting body. Also, instead of the releasing paper 22 as a back-up sheet, a releasing sheet can be used initially and after the adhering of the reinforcing fiber 25, the releasing paper 22 can be affixed instead of the releasing sheet.

As explained above, according to the present invention, since a spray device having a plurality of nozzles tipped with capillary tubes surrounded by gas discharge pores is used and a molten resin liquid is blown out from the ends of the capillary tubes by the heated air streams discharged from the gas discharge pores onto a reinforcing fiber, a uniform and thin resin layer can be formed directly on the reinforcing fiber, and thus a reinforcing fiber sheet can be produced more efficiently. Also, according to the present invention, by using the special spray device mentioned above, a fuzz-preventing layer can be formed on the reinforcing fiber, and thus a reinforcing fiber sheet designed to prevent fuzzing of the reinforcing fiber can be produced.

What is claimed is:

1. A method of producing a reinforcing fiber sheet comprising:

providing a spray device having a plurality of nozzles each of which has a capillary tube surrounded by a gas discharge pore at the end of said nozzle;

blowing out a molten resin liquid from a lower end of said capillary tube by a heated air stream discharged through the gas discharge pore to reinforcing fiber bundles and forming a binder resin layer on the reinforcing fiber bundles;

applying a resin-permeable supporting sheet and then a second sheet to the binder resin layer side of the reinforcing fiber bundles, and applying a third sheet to the other side of the reinforcing fiber bundles to form superposed layers; and pressing said superposed layers to adhere the reinforcing fiber bundles, the resin-permeable supporting sheet, the second sheet and the third sheet to each other.

2. A method of producing a reinforcing fiber sheet according to claim 1, wherein the second sheet comprises a back-up sheet and the third sheet comprises a releasing sheet.

3. A method of producing a reinforcing fiber sheet according to claim 2, wherein the second sheet comprises a first releasing sheet and the third sheet comprises a second releasing sheet, and the method further comprises the step of peeling the first releasing sheet and applying a back-up sheet to affix the back-up sheet to the resin-permeable supporting sheet.

* * * * *